US005473923A

United States Patent [19]

Hochspach et al.

[11] Patent Number: 5,473,923

[45] Date of Patent: Dec. 12, 1995

[54] METHOD OF INTERMITTENT STRAIGHTENING OF WIRE

[75] Inventors: Edgar Hochspach, Wettingen; Robert Widmer, Hausen, both of Switzerland

[73] Assignee: H.A. Schlatter AG., Schlieren, Switzerland

[21] Appl. No.: 197,882

[22] Filed: Feb. 17, 1994

[30] Foreign Application Priority Data

Mar. 25, 1993 [CH] Switzerland ..... 913/93

[51] Int. Cl.[6] ..... B21F 1/02; B21F 1/00; B21D 3/00; B21D 3/06

[52] U.S. Cl. ..... 72/79; 72/160; 140/140; 140/139

[58] Field of Search ..... 72/79, 72, 70, 72/183, 160; 140/139, 140

[56] References Cited

U.S. PATENT DOCUMENTS 3,879,978 4/1975 Harris, Jr. ..... 72/160
4,046,177 9/1977 Louis et al. ..... 72/79
4,920,776 5/1990 Denzler ..... 72/79
5,327,757 7/1994 Wirth ..... 72/79

FOREIGN PATENT DOCUMENTS 0313769 5/1989 European Pat. Off. .

*Primary Examiner*—Lowell A. Larson
*Assistant Examiner*—Rodney Butler
*Attorney, Agent, or Firm*—Brady, O'Boyle & Gates

[57] ABSTRACT

In a device for intermittent straightening of wire there are independent drives for wire feed and the straightening rotor. The speed of rotation ($v_2$) of the straightening rotor varies essentially synchronously to the feed rate ($v_1$) of the wire. To cut the wire ($t_4$) the wire and rotor are stopped. According to the invention the direction of rotation of the rotor is reversed between successive working cycles.

8 Claims, 2 Drawing Sheets

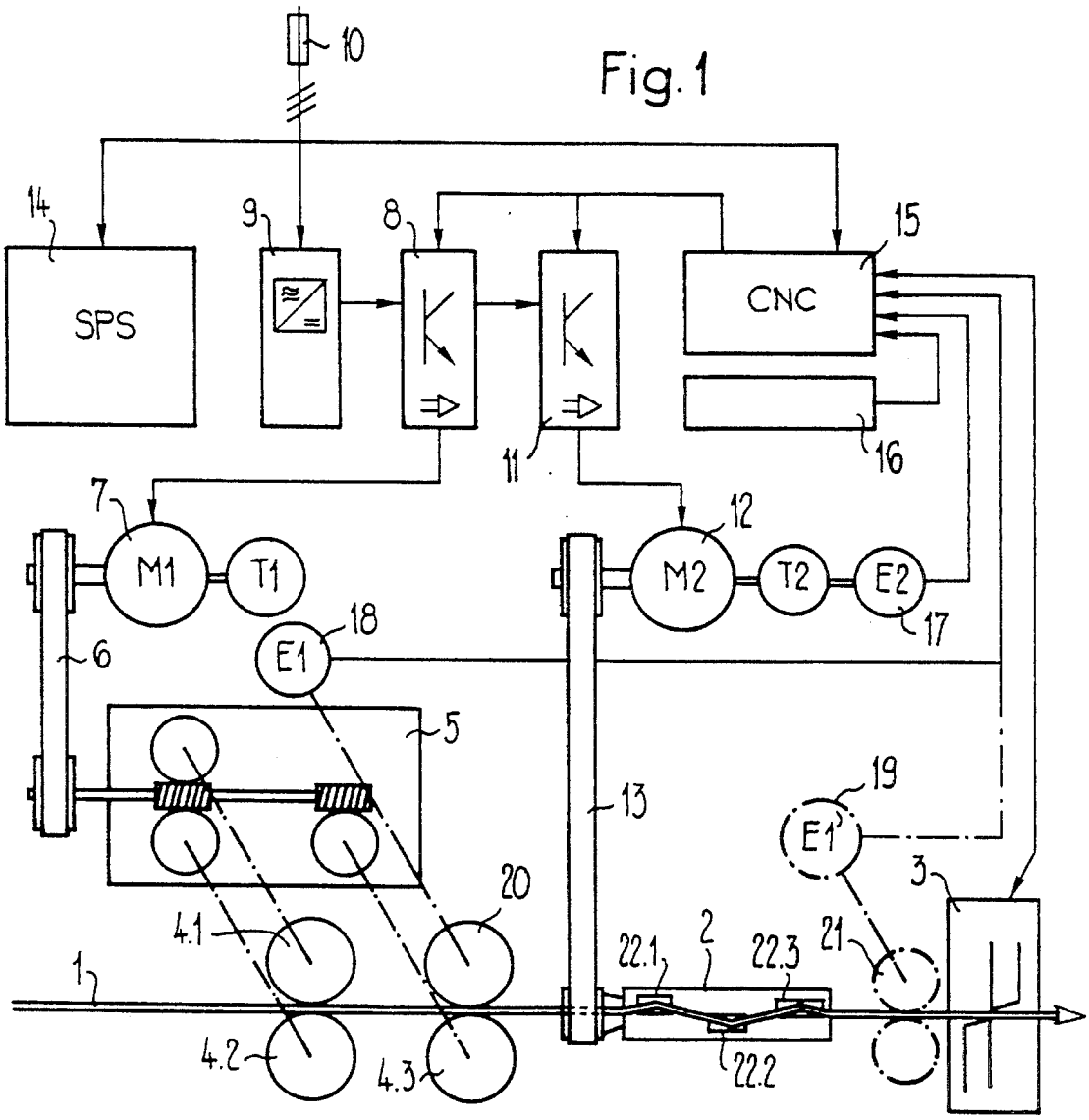
Fig. 1
10
14
SPS
9
8
15
CNC
16
11
7
M1
T1
12
M2
T2
E2
17
18
E1
6
5
13
19
E1'
3
20
4.1
21
22.1
2
22.3
1
4.2
4.3
22.2
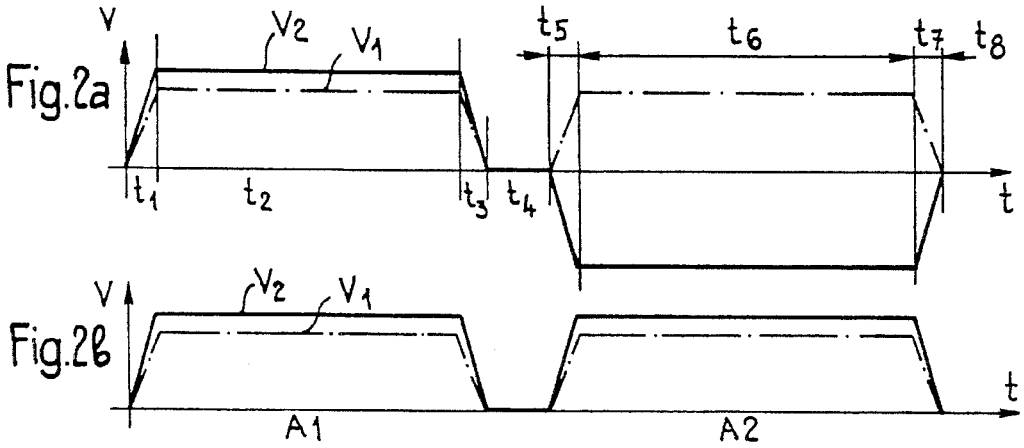
Fig.2a
V
V2
V1
t5
t6
t7
t8
t1
t2
t3
t4
t
Fig.2b
V
V2
V1
t
A1
A2

METHOD OF INTERMITTENT STRAIGHTENING OF WIRE

TECHNICAL DOMAIN

The invention relates to a process of intermittent straightening of wire in which, during one working cycle, a) the wire is accelerated to a set feed rate, b) it is radially deflected by a group of straightening stones of a rigidly mounted straightening rotor which rotates at a set angular velocity, and c) it is slowed down for subsequent wire working.

PRIOR ART

A process of the aforementioned type is known from EP-0 313 769-B1. The device for executing the process which can likewise be taken from this patent is characterized by the fact that the angular momentum of the straightening rotor is made so small that the straightening rotor can be slowed down and speeded up at least approximately at the same time as the wire. The conveying means for advancing the wire and the straightening rotor can be synchronously slowed down and speeded up by a common drive device. In this way mechanical problems of flying shears or movement of the straightening rotor in the direction of the wire can be avoided.

DESCRIPTION OF THE INVENTION

The problem of the invention is to further develop a method of the type mentioned at the beginning in view of reduced wear or a longer service life of the straightening rotor stones.

According to the invention the solution consists in that the straightening rotor rotates with a direction of rotation which repeatedly changes between the working cycles. The straightening rotor is therefore no longer driven continuously in the same direction. Rather, the direction of rotation is changed at least now and then. For the straightening stones this yields more uniform wear and a longer service life.

Preferably the direction of rotation is periodically changed. However, the direction of rotation need not be changed for each working cycle. Even two, three or more working cycles in succession can have the same direction of rotation. By periodically changing the direction the degree of wear of the straightening stones in either direction will be roughly the same at any time.

At the end of one working cycle the straightening rotor is advantageously brought into an angular position in which the torque exerted by the wire on the straightening rotor is essentially zero. If specifically the straightening rotor is simply braked and then locked, the wire has an internal twist and thus a certain internal stress. This can be eliminated by briefly reversing the straightening rotor after braking.

The wire and the straightening rotor are preferably speeded up and slowed down essentially synchronously. The straightening rotor and the conveying means for transporting the wire are driven by two separate drives (for example, electric motors) according to one preferred embodiment of the invention. A common control ensures synchronous operation. The feed per rotor revolution (straightening quality) can be almost freely selected or programmed.

The control circuit which, among other, stipulates the alternating direction of rotation can be advantageously programmed for purposes of adjustment of the ratio of feed rate of the wire to the angular velocity of the straightening rotor. The device according to the invention can thus be easily adjusted to different wire thicknesses.

In order to eliminate the twist of the wire which prevails at the end of a working cycle and which leads to torque which is transferred to the straightening rotor, the control circuit, for example, generates a signal which leads to a number of revolutions of the straightening rotor opposite to the direction of rotation of the corresponding working cycle. In this way the rotor drive can be cleared in the cutting pauses. During this time the drive must not generate any stationary torque and thus needs no energy from the power supply network either.

Other advantageous features and combinations of features of the invention follow from the entirety of the description and the patent claims.

BRIEF DESCRIPTION OF THE DRAWINGS

Below the invention will be detailed using examples of embodiments and in conjunction with the drawings.

FIG. 1 shows a block diagram of a device according to the invention;

FIG. 2*a, b* show two speed-time diagrams according to which the device according to the invention can be operated;

EMBODIMENTS OF THE INVENTION

Figure 3:
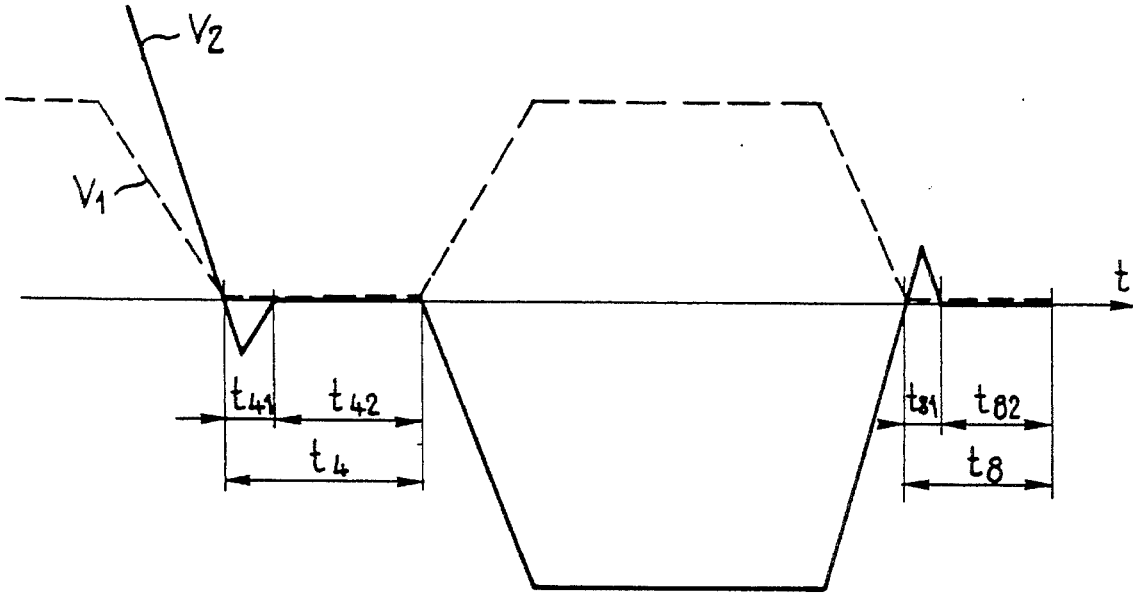
FIG. 3 shows curves in the speed-time diagram for attaining an imperceptible torque during the cutting pauses.

FIG. 1 shows a block diagram of a device for executing the process according to the invention. Wire 1 is pushed through rigidly mounted straightening rotor 2 using conveying means (still to be described in detail). In the rotor, wire 1 undergoes radial deflection in straightening stones 22.1, 22.2, 22.3. Wire 1 is cut using cutting device 3 at the desired intervals.

The conveying means comprise driving wheels 4.1, 4.2, 4.3 which are driven via the axles of transmission 5 shown in outline. Transmission 5 is, for example, a worm gear pair which is suspended on the axle of motor 7 via toothed belt 6.

Straightening rotor 2 for its part is driven by motor 12 via toothed belt 13. The two motors, 7 and 12, are each triggered by a separate servo amplifier 8 or 11. Servo amplifiers 8, 11 for their part are powered with direct current from converter 9. The entire system is supplied from three-phase network 10.

Switching stages 8 and 11 are triggered and monitored by CNC control 15.

CNC control 15 exchanges data with a known SPS circuit 14. In addition, it receives signals from angular resolvers 17, 18 and possibly 19. Certain operating conditions and/or operating modes can be set via input device 16. The input device is connected to the CNC via a communications line.

Finally there is also a communications line to cutting device 3.

Angular resolver 18 is coupled to measuring wheel 20 which, for example, is designed as the mating wheel to driving wheel 4.3. With it wire feed can be measured at the input of straightening rotor 2. At the output of straightening rotor 2 there can also be measuring wheel 21 which determines the feed and speed of the straightening wire (angular resolver 19). The speed of rotation of straightening rotor 2 is determined with angular resolver 17 located on the axle of motor 12.

The structural details of the device according to the invention, to the extent they do not follow from the aforementioned description and FIG. 1, can be as described as in EP-0 313 769-B1. Within the framework of the invention however other embodiments are also possible.

Using FIG. 2*a*, 2*b*, the principal characteristics of the process according to the invention will be explained. Time t is plotted on the x-axis and speed v on the y-axis. $v_1$ is the speed of wire 1 (measuring wheel 20). $v_2$ is the speed of motor 12 and is proportional to the speed of rotation of straightening rotor 2.

At the start of one working cycle, wire 1 and straightening rotor 2 are synchronously speeded up (time interval $t_1$). When a set feed rate and a corresponding rotor speed are reached the two motors, 7 and 12, rotate with an essentially constant speed (time interval $t_2$). The ratio between the wire feed rate and speed of rotation is determined among others by the wire thickness.

After a predetermined wire length has been straightened in this way, motors 7 and 12 are slowed down until they stop (time interval $t_3$). During subsequent time interval $t_4$ the wire is cut by cutting device 3.

At this point the next working cycle begins. Within time interval $t_5$ the two motors, 7 and 12, are speeded up again. However, according to the invention the direction of rotation of motor 12 and thus of straightening rotor 2 was reversed. That is, it turns in a direction opposite the direction of rotation of the preceding working cycle ($t_1, \ldots, t_4$). (The direction of rotation of motor 7 which is responsible for the feed rate is of course not reversed, i.e. $v_1$ remains positive). In time interval $t_6$ motors 7 and 12 again turn with an essentially common speed. Afterwards wire 1 and rotor 2 are again slowed down (time interval $t_7$). After completion of time interval $t_8$ the second working cycle is ended. According to one especially preferred embodiment the direction of rotation of rotor 2 is again reversed, i.e., the operating process according to FIG. 2 begins, anew ($t_1, t_2, \ldots$).

The direction of rotation of course need not be reversed after each working cycle. It can, for example, be inverted every two, three, etc., working cycles. This can be advantageous, especially when it is not desired that the rotor comes to a complete stop. The rotor need only ever be stopped when the direction of rotation is changed.

The device shown in FIG. 1 can of course also be used to straighten a wire in the conventional way (compare EP-0 313 769-B1). This is illustrated in FIG. 2*b*. In successive working cycles $A_1$, $A_2$ the variation of speeds $v_1$, $v_2$ is identical both in terms of sign and amount to the corresponding times.

The different operating modes are stored, for example, in SPS circuit 14 and can be selected by inputting on input device 16. Because independent drives which are "connected" only by a common control ("electronic axle") are available for wire feed and the straightening rotor, there are a host of possibilities for operation of the device.

Using FIG. 3 one embodiment of the invention will be explained in which towards the end of each working cycle the elastic stress of the wire caused by twisting is dissipated. Twisting of the wire is dissipated in time intervals $t_4$ or $t_8$. Speed $v_1$ of wire 1 has the same time behavior as in FIG. 2*a*. Conversely, speed $v_2$ of motor 12 behaves differently. It is not always zero during time interval $t_4$, but makes a small negative spike in subinterval $t_{41}$ before it again assumes the zero value (subinterval $t_{42}$). That is, at the end of the slowing down process speed $v_2$ passes through zero, rises briefly in the opposite direction, and is then again slowed down to zero. The reverse rotation of the wire generated in time interval $t_{41}$ is roughly so great that a twisting torque which prevails in the wire is at least approximately zero.

The same takes place in time interval $t_8$ in which speed $v_2$ passes through zero from negative to positive, makes a small peak and then drops to zero. This short reversal of the rotor is preferably executed for each change in the direction of rotation.

The curve behaviors shown in FIGS. 2*a*, 2*b* and 3 should be examined more in the sense of descriptions of principles than specific constraints. The increases and decreases of speed of course need not be unconditionally linear. In particular, the peaks shown in time intervals $t_{41}$ and $t_{81}$ need not be realized in this form. It is primarily the integral of the peaks shown which is important; it is proportional to the angle of rotation. The objective should of course also be to dissipate the twisting as quickly and energy-efficiently as possible.

The direction of rotation of the straightening rotor can also be changed in principle by using a suitable transmission. For this purpose it is therefore not absolutely necessary to provide two separate motors for wire feed and the straightening rotor.

In summary, it can be held that in a device operated according to the invention more uniform wear of the wearing parts (straightening stones) is enabled.

We claim:

1. A process for the intermittent straightening of wire, comprising the steps of a) accelerating the wire to a set feed rate and synchronously speeding up the axial rotation of a rigidly mounted straightening rotor to a set angular velocity and feeding the wire through the straightening rotor;

b) radially deflecting the wire with a group of straightening stones on the rigidly mounted straightening rotor as it axially rotates at the set angular velocity;

c) slowing down the wire from the set feed rate and slowing down the straightening rotor for subsequent wire working;

d) reversing the direction of rotation of the straightening rotor and axially rotating it at the set angular velocity in the opposite direction while again feeding the wire therethrough at the set feed rate.

2. A process for the intermittent straightening of wire according to claim 1, including periodically reversing the direction of rotation of the straightening rotor.

3. A process for the intermittent straightening of wire according to claim 1, including after the slowing-down step, stopping the feeding of the wire and rotating the straightening rotor into an angular position to reduce the twisting torque in the wire caused by elastic twisting of the wire in the straightening rotor, to essentially zero.

4. A process for the intermittent straightening of wire according to claim 1, including synchronously speeding up and slowing down the feeding of the wire and the rotation of the straightening rotor.

5. A process for the intermittent straightening of wire according to claim 3, in which during the reducing of the twisting torque in the wire to essentially zero, including stopping the rotation of the straightening rotor and briefly rotating the straightening rotor in the opposite direction and thereafter stopping the rotation.

6. Apparatus for the intermittent straightening of wire, comprising a) conveying means for transporting the wire to be straightened, b) rotational straightening rotor means positioned for the transport of the wire therethrough and including a plurality of straightening stones therein for radial deflection of the wire as it passes therethrough, c) first motor means connected to said conveying means for transporting the wire, d) second motor means connected to rotate said straightening rotor, and e) common control circuit means connected to said first motor means to rotate it in one direction for transporting the wire in one direction axially through said straightening rotor, and connected to said second motor means for repeatedly changing the direction of rotation of said straightening rotor during transport of the wire in said one direction, whereby uniform wear and longer service life of the said straightening stones is achieved.

7. Apparatus for the intermittent straightening of wire according to claim 6, including memory circuit means connected to said common control circuit means for adjustment of the speeds of the first and second motor means as related to the adjustment of the ratio of the transport rate of the wire to the angular velocity of rotation of said straightening rotor.

8. Apparatus for the intermittent straightening of wire according to claim 6, and said common control circuit means operative to synchronously slow down and stop said first and second motor means, and briefly rotate said second motor means and said straightening rotor in the opposite direction from the stopping direction while said first motor means is at a stop, to minimize the twisting torque exerted by the wire.

* * * * *